US006702378B2

(12) United States Patent
Bullard

(10) Patent No.: US 6,702,378 B2
(45) Date of Patent: Mar. 9, 2004

(54) LIFT CHAIR SKIRT

(75) Inventor: Larry I. Bullard, Winston-Salem, NC (US)

(73) Assignee: L & P Property Management Company, South Gate, CA (US)

( * ) Notice: Subject to any disclaimer, the term of this patent is extended or adjusted under 35 U.S.C. 154(b) by 100 days.

(21) Appl. No.: 10/071,153

(22) Filed: Feb. 8, 2002

(65) Prior Publication Data

US 2002/0125751 A1 Sep. 12, 2002

Related U.S. Application Data

(60) Provisional application No. 60/267,511, filed on Feb. 8, 2001.

(51) Int. Cl.[7] ..... A47C 27/00

(52) U.S. Cl. ..... 297/224; 297/228.13; 297/DIG. 10

(58) Field of Search ..... 297/219.1, 224, 297/228.13, 218.3, 218.1, 218.5, DIG. 10, 325; 29/428; 5/493

(56) References Cited

U.S. PATENT DOCUMENTS 2,763,875 A * 9/1956 Piontkowski
4,225,179 A * 9/1980 Oltrona Visconti
5,271,112 A * 12/1993 Bible et al.
5,540,480 A * 7/1996 Christa
5,664,832 A * 9/1997 Stevens et al.
5,676,422 A * 10/1997 White et al.
5,715,553 A * 2/1998 Baron et al.
5,802,637 A * 9/1998 Bordo
5,946,750 A * 9/1999 Shiu
6,155,637 A * 12/2000 Waters
6,213,554 B1 * 4/2001 Marcoux et al.

* cited by examiner

*Primary Examiner*—Milton Nelson, Jr.
(74) *Attorney, Agent, or Firm*—Shook, Hardy & Bacon, LLP

(57) ABSTRACT

A method and apparatus for concealing a lift mechanism associated with a lift chair is provided. The lift chair includes a seating unit and a support frame. The apparatus is a piece of elastic material that includes a front panel, rear panel and a pair of side panels that are shaped to extend between the support frame and the seating unit. In particular, the side panels are tapered as they extend from the rear panel to the front panel. In concealing the lift mechanism, the front and rear panels extend around a front and rear bar respectively to conceal a top portion of the lift mechanism. In addition, front and rear panels may be coupled to one another by a coupling mechanism, such as a zipper. Further, a pull cord selectively secures the skirt to the bottom portion of the support frame.

20 Claims, 4 Drawing Sheets

LIFT CHAIR SKIRT

CROSS REFERENCE TO RELATED APPLICATIONS

This application claims the benefit of U.S. Provisional Application No. 60/267,511 filed Feb. 8, 2001.

STATEMENT REGARDING FEDERALLY-SPONSORED RESEARCH OR DEVELOPMENT

Not applicable.

BACKGROUND OF THE INVENTION

The present invention relates to chairs having a lift mechanism associated therewith. More specifically, this invention relates to an apparatus that conceals the lift mechanism of the chair, even when the chair is in a lifted or reclined position.

Chairs and sofa modules that recline and that have an extendable footrest are known within the art. Typically, these chairs have a hand-activated mechanism that is used to position the chair in a TV position (where the footrest is placed in an extended position with the seat back only slightly reclined), an advanced reclining position (where the footrest is placed in an extended position and the seat back is fully reclined), and a fully upright position (where the footrest is stowed and the seat back is upright). Positioning the chair in the TV position, advanced reclining position and upright mode can be difficult for some individuals. Moreover, some individuals have a difficult time getting into and out of such a chair.

In an effort to assist individuals in getting into and out of reclining chairs, it is known within the art to equip the chairs with a lift mechanism. The lift mechanism positions the chair between a sitting position, such as that shown in FIG. 4, and a tilted position, such as that shown in FIG. 2. It can be seen that the lift mechanisms thus assist the user in entering and exiting the chair. The lift mechanism is mounted underneath the seat of the chair and operates to tilt the seat forward so that a user is almost standing up when the lift mechanism is in a fully extended position. An example of a motorized lift mechanism that may be used on chairs is shown in U.S. Pat. No. 6,213,554 issued to Marcoux et al.

As the lift mechanism raises the seat to place the seat in a tilted position, the lift mechanism, as well as other mechanical linkages and components of the lift chair, are exposed to an external environment. In other words, the lift mechanism and other linkages are accessible. A similar type of exposure and accessibility is present in a front portion of the chair when the chair is placed in the TV and advanced reclining positions, where the footrest is in an extended position. The exposure of the lift mechanism and other linkages in these instances present certain disadvantages and drawbacks. First, the exposure allows the lift mechanism to be viewed by the user of the chair and others around the chair. Such a view can be considered unattractive by those in the vicinity of the chair. Second, the exposure also presents the potential of exposure of the lift mechanism and other linkages to external object, including people and pets. This exposure is undesirable for both the objects and the mechanical linkages. Therefore, the lift chair must be operated with extra caution to protect both external objects and the lift mechanism and linkages.

Accordingly, there exists a need for an apparatus that can be used on lift chairs which overcomes the above drawbacks and deficiencies. More specifically, an apparatus is needed that reduces the exposure to the lift mechanism and other components when the chair is in a tilted position. The present invention fills these needs as well as various other needs.

BRIEF SUMMARY OF THE INVENTION

In order to overcome the above-stated problems and limitations, and to achieve the noted objects, there is provided an apparatus that may conceal a lift mechanism associated with a lift chair.

In general, the apparatus conceals the lift mechanism when the lift chair is in a tilted, TV or advanced reclining positions. The lift chair includes a seating unit and a support frame. The apparatus is a piece of material that includes a front panel, rear panel and a pair of side panels that are adapted to extend between the support frame and the seating unit. In particular, the side panels are tapered as they extend from the rear panel to the front panel. In concealing the lift mechanism, in one embodiment the front and rear panels extend around a front and rear bar respectively to conceal a top portion of the lift mechanism. In addition, front and rear panels may be selectively coupled to one another by a zipper. Further, a pull cord may be provided to secure the skirt to the bottom portion of the support frame.

The present invention further provides for a method for shrouding the lift mechanism associated with the lift chair. The method involves providing a piece of material, and coupling the piece of material between the support frame and the seating unit. The piece of material conceals at least a portion of the lift mechanism when the lift chair is moved between the seated and tilted positions. The method may further provide a zipper that couples two portions of the piece of material to conceal the top portion of the lift mechanism. Further, at least one aperture may be formed in the piece of material so that the piece of material may be coupled to the support frame. The method also involves providing a pull cord that may be tightened to secure the piece of material to the support frame.

Additional objects, advantages and novel features of the invention will be set forth in part in the description which follows, and in part will become apparent to those in the practice of the invention.

BRIEF DESCRIPTION OF THE SEVERAL VIEWS OF THE DRAWINGS

In the accompanying drawings which form a part of this specification and which are to be read in conjunction therewith, and in which like reference numerals are used to indicate like parts and their various views.

DETAILED DESCRIPTION OF THE INVENTION

Figure 1:
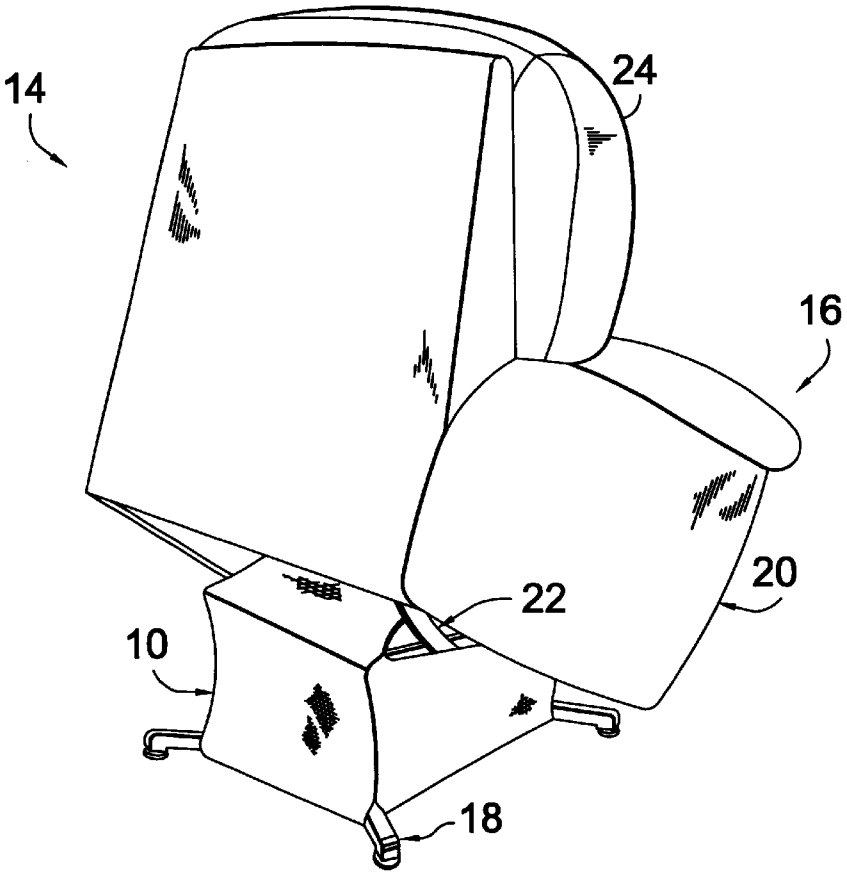
FIG. 1 is a rear perspective view of a lift chair in a tilted position having a skirt concealing a lift mechanism located beneath the lift chair constructed according to a preferred embodiment of the present invention.
Figure 7:
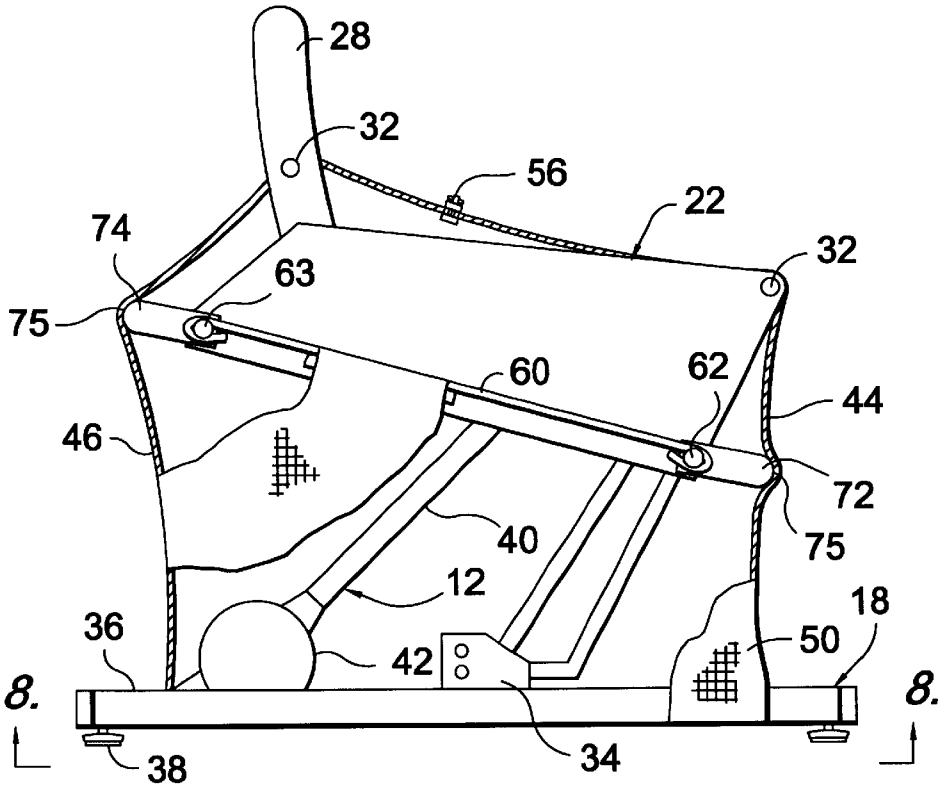
FIG. 7 is a side elevational view of the skirt with portions broken away showing the lift mechanism in an extended position.

Referring now to the drawings in detail, and initially to FIGS. 1 and 7, numeral 10 generally designates a skirt constructed in accordance with a preferred embodiment of the present invention. Skirt 10 is generally used to conceal or surround a lift mechanism 12 that is mounted beneath a lift chair 14. Lift chair 14 generally includes a seating unit 16 that is supported upon a support frame 18. Lift mechanism 12 is coupled between seating unit 16 and the frame 18 and operates to move seating unit 16 between a seated position (shown in FIG. 4) and a tilted position (shown in FIG. 1). When seating unit 16 is moved between the seated and tilted positions, seating unit 16 moves away from support frame 18, thereby exposing lift mechanism 12 to an external environment should skirt 10 not be installed. Skirt 10 is adapted to be coupled to support frame 18 and seating unit 16 and form a barrier between lift mechanism 12 and the external environment and to conceal at least a portion of lift mechanism 12.

Figure 2:
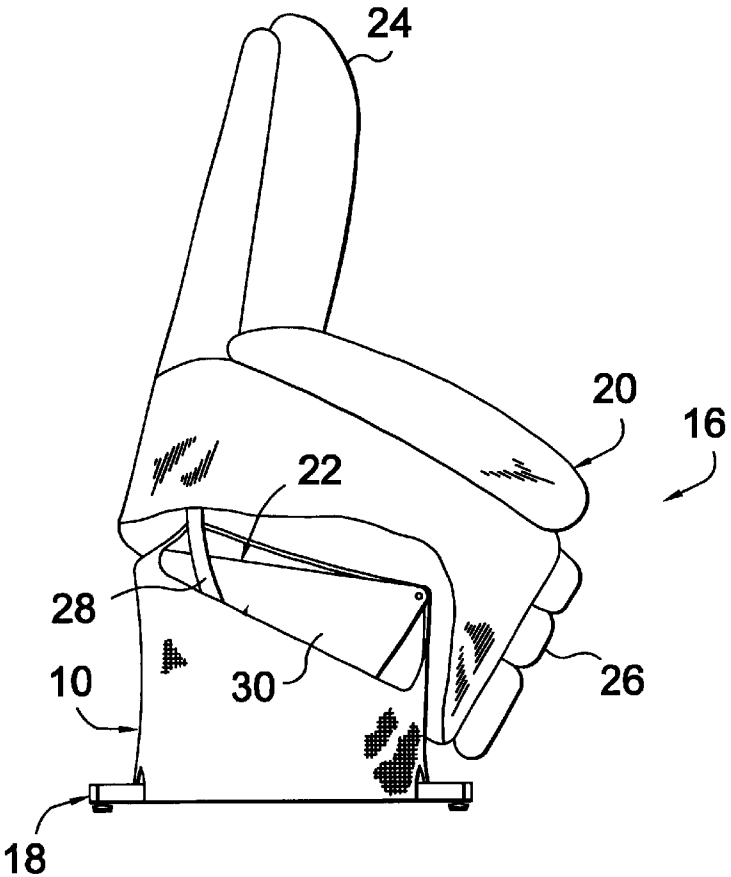
FIG. 2 is a side elevational view of the lift chair with portions broken away showing the lift chair in the tilted position with the skirt concealing the lift mechanism.
Figure 6:
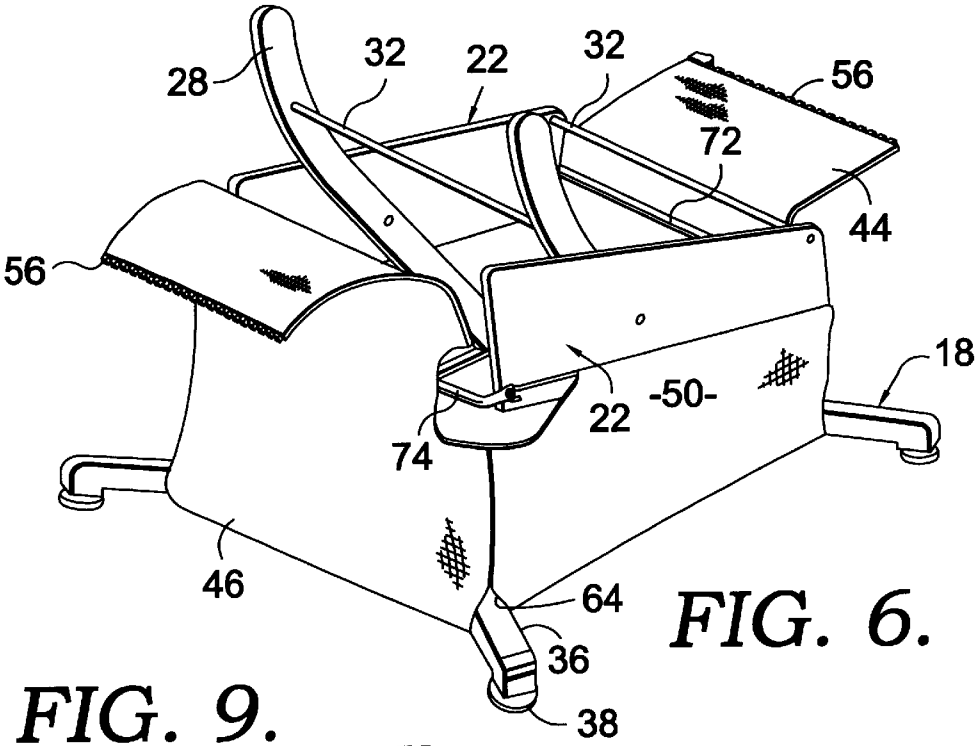
FIG. 6 is a rear perspective view of the lift mechanism in the tilted position with the skirt in an unzipped position.
Figure 5:
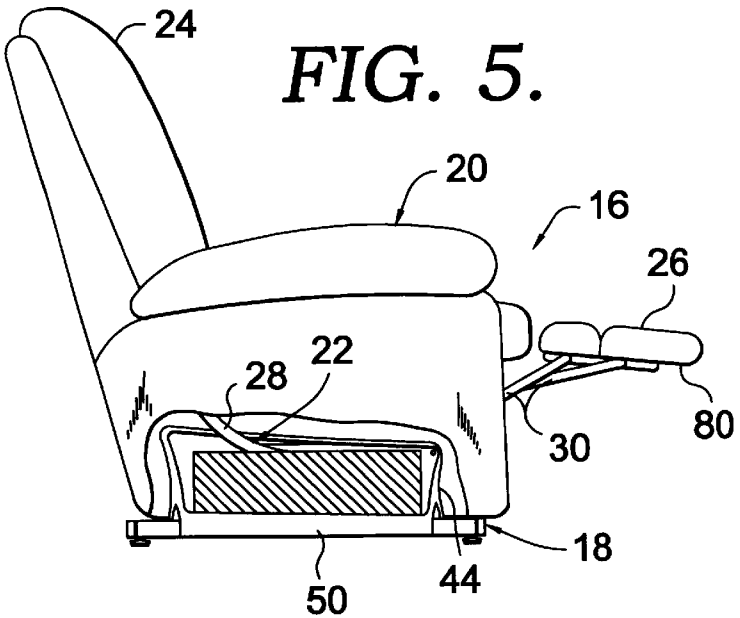
FIG. 5 is a side elevational view of the lift chair in a TV position with portions broken away showing the skirt concealing the lift mechanism.

As best seen in FIG. 2, seating unit 16 generally includes a seat 20 and a base 22. Seat 20 includes a backrest 24 that may be moved to various reclined positions and a footrest 26 that may be selectively placed in an extended position. As best seen in FIGS. 5 and 6, base 22 is mounted underneath seat 20 and includes backrest linkages 28 that allow backrest 24 to move between an upright position and reclined position. In addition, base 22 includes a plurality of footrest linkages 30 that allow footrest 26 to be moved between extended and retracted positions. Backrest linkages 28 and footrest linkages 30 on both sides of base 22 are stabilized by cross-members 32. Further, as best seen in FIG. 7, base 22 is pivotally mounted to support frame 18 by a mounting linkage 34 so that base 22 may be lifted to a tilted position by lift mechanism 12 without being separated from support frame 18.

Figure 8:
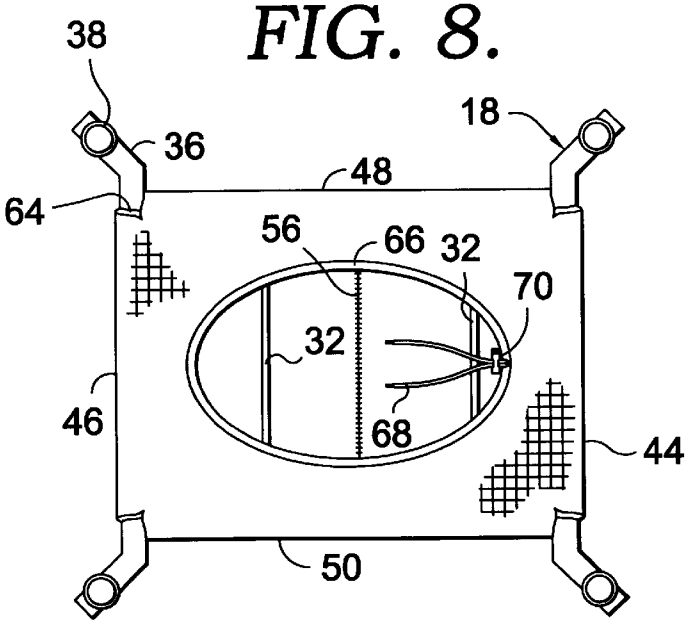
FIG. 8 is a bottom plan view taken along line 8—8 of FIG. 7 showing the skirt coupled to the lift chair showing the pull cord in a tightened position.

As best seen in FIGS. 6 and 8, support frame 18 is adapted to be placed beneath seating unit 16 and includes four outwardly extending feet 36 having stabilizers 38 coupled to the distal ends thereof. Stabilizers 38 are adapted to prevent support frame 18 from rocking on a support surface. Support frame 18 is adapted to maintain contact with the support surface, such as the floor, when seating unit is in a seated, reclined and tilted position.

Figure 4:
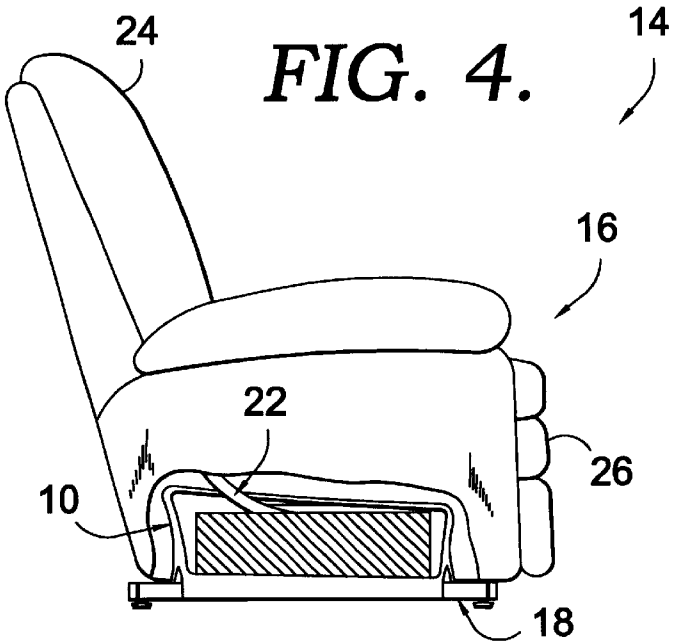
FIG. 4 is a side elevational view of the lift chair in a seated position with portions broken away to show the skirt concealing the lift mechanism.

Lift mechanism 12 is adapted to move seating unit 16 between a seated position and tilted position. As best seen in FIG. 7, lift mechanism 12 includes a lift arm 40 and an actuating mechanism 42. One end of lift arm 40 is mounted to base 22 and the opposite end is mounted to actuating mechanism 42. Actuating mechanism 42 is mounted to support frame 18 and operates to move lift arm 40 between an extended position and a retracted position. When lift mechanism 12 is in the extended position, base 22 is in a tilted position. In addition, when lift mechanism 12 is in the retracted position, base 22 is in a seated position as illustrated in FIG. 4.

While the above-portion of the description describes and explains a preferred embodiment for the base of the lift chair 14, it should be understood that the invention is in no way limited to any specific lift chair construction. As would be understood by those of skill in the art, the principles of the skirt 10 of the invention may readily be employed on any of a variety of chairs have differing constructions.

Figure 9:
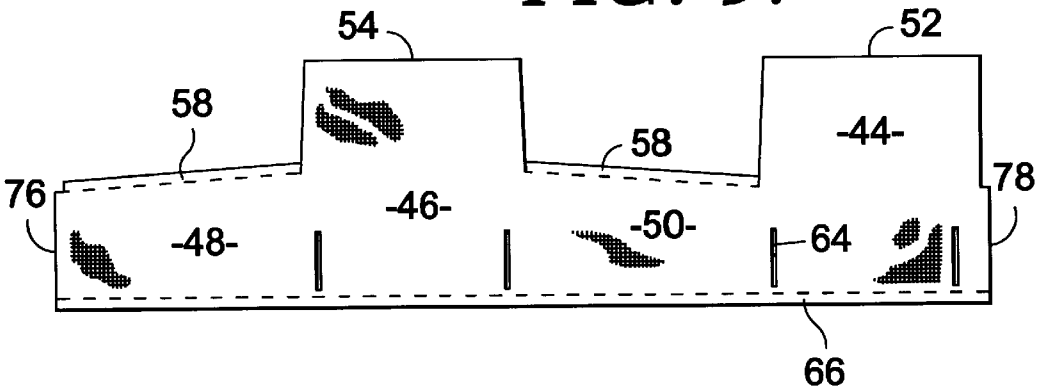
FIG. 9 is a plan view of the pattern piece that is used to form the skirt.

Turning now to a more-detailed description of the inventive skirt 10, as best seen in FIG. 9, skirt 10 is adapted to conceal lift mechanism 12. Skirt 10 is preferably made from an elastic material and includes a front panel 44, a rear panel 46, a right side panel 48 and a left side panel 50. The pattern including panels 44, 46, 48, 50 is preferably made from a unitary piece of material. As best seen in FIG. 6, one portion of a zipper 56 is coupled to a top edge 52 of front panel 44 and the corresponding portion of zipper 56 is coupled to a top edge 54 of rear panels 46. As more fully-explained below, zipper 56 is used to selectively couple top edge 52 of front panel 44 with top edge 54 of rear panel 46. Front and rear panels 44, 46 are sized and shaped to extend from support frame 18 and over the cross members 32 when the front and rear panels are coupled to one another by zipper 56. Right and left side panels 48, 50 taper as they extend from rear panel 46 to front panel 44. In other words, as viewed in FIG. 9, the height of panel 48 decreases from right to left and the height of panel 50 decreases from left to right. A pair of slots 58 are formed in a top portion of the right and left side panels 48, 50. As more fully described below, slots 58 are used to accommodate a pair of rods 60 that pass therethrough. The side panels 48, 50 elevate from a lowered position shown in FIGS. 4 and 5 to an elevated position as shown in FIG. 1. The reclining mechanism of the chair is not covered when the chair is the in lowered position of FIGS. 4 and 5, and is shown as a cross-hatched area in FIGS. 4 and 5 for simplicity. As best seen in FIG. 7, each rod 60 includes a curled end portion that is fastened to front and rear portions of base 22 by a fastener 62. As best seen in FIGS. 6 and 9, skirt 10 further includes four apertures 64 that are formed along the material generally at the intersection of each pair of adjacent panels 44, 46, 48, 50. Apertures 64 may be closed ended as shown, or open ended to the bottom of the panel. Apertures 64 are provided to allow feet 36 to be placed therethrough to secure skirt 10 to support frame 18. It will be understood and appreciated that more or less than four apertures may be included in skirt 10 without departing from the scope of the present invention. As best seen in FIGS. 8 and 9, a slot 66 is provided along a bottom edge of panels 44, 46, 48, 50. As more fully explained below, a pull cord is placed through slot 66. Pull cord 68 is equipped with a locking clasp 70 that is provided to draw the skirt 10 underneath support frame 18 to further secure skirt 10 to support frame 18. As stated above, skirt 10 is preferably constructed of an elastic material. The material is preferably one that allows skirt 10 to extend between the seated position of FIG. 4 and the extended position of FIG. 2, while remaining substantially taught in all positions therebetween.

In an alternative embodiment, front and rear skirt bars 72, 74 are coupled to base 22 in a position holding skirt 10 away from base 22 so as not to interfere with the tilting, reclining or seating of base 22. As best seen in FIGS. 6 and 7, front skirt bar 72 is coupled to a lower front portion of base 22 by fastener 62. Similarly, rear skirt bar 74 is coupled to a lower rear portion of base 22 by fastener 63. Preferably, the outer edge 75 of each skirt bar 72, 74 is rounded to provide a smooth surface over which the skirt may ride, the importance of which is made clear below.

In installing skirt 10 on lift chair 14, a left edge 76 of panel 48 is sewn to a right edge 78 of panel 50. Pull cord 68 is fed through slot 66 and the locking clasp 70 is exposed for later use. Feet 36 located in the front of support frame 18 are placed through apertures 64 formed in front panel 44. Similarly, feet 36 located in the rear of support frame 18 are placed through apertures 64 formed in rear panel 46. As best seen in FIG. 7, rods 60 are placed in slots 58 located in right and left side panels 48, 50. Fasteners 62 are then slipped through the curled end portions of rods 60 and are used to mount rods 60 to opposite sides of base 22. In addition, front and rear bars 72, 74 are fastened to base 22 by fasteners 62, 63 at the same time rods 60 are coupled to base 22. This may be accomplished by placing the distal ends of bars 72, 74 between the curled ends of rods 60 and base 22. Fasteners 62 are then used to couple bars 72, 74 and rods 60 to base 22. It will be understood and appreciated that the present invention may also be constructed without front and rear bars 72, 74.

Figure 3:
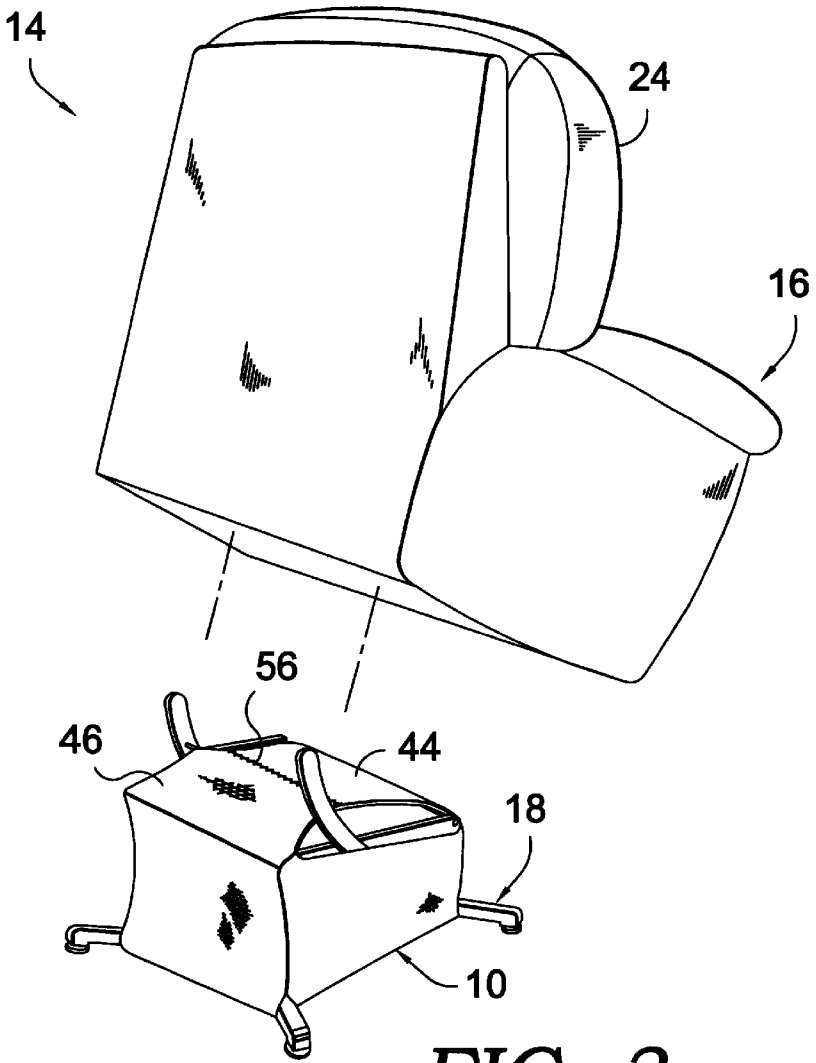
FIG. 3 is an exploded rear perspective view similar to FIG. 1 showing the skirt in a zipped position concealing a top portion of the lift mechanism.

At this point of the assembly, the present invention is in the form illustrated in FIG. 6. As best seen in FIGS. 6 and 7, front and rear panels 44, 46 are positioned over cross members 32 and joined together by zipper 56. As best seen in FIG. 8, pull cord 68 is then pulled tight and locking clasp 70 is positioned to hold cord 68 in this tightened position. Once placed on lift chair 14, the present invention is in the form illustrated in FIG. 3. It will be understood and appreciated that skirt 10 may be coupled to support frame 18 and seating unit 16 when lift chair is in a seated or reclined position, although it is preferably installed with the chair in the seated position.

In use, skirt 10 operates to conceal or surround lift mechanism 12 from the external environment. Specifically, as best seen in FIG. 4, skirt 10 conceals lift mechanism 12 when lift chair 14 is in a seated position. As noted above, the skirt 10 does not conceal the reclining mechanism represented in a cross-hatch, which is protected from exposure by the chair itself. In this position the material of skirt 10 is in a more relaxed state. Preferably, however, the material is such that it does not sag or gather when the chair is in the seated position. As best seen in FIGS. 1 and 2, the movement of lift chair 14 to a tilted position causes seating unit 16 to move away from support frame 18. When the chair 14 is in the tilted position, skirt 10 stretches to create a barrier between lift mechanism and the external environment. In this position, the material of skirt 10 is more taught than it was in the seated position. In particular, front and rear panels 44, 46 conceal top, front and rear portions of the lift mechanism 12. In addition, right and left side panels conceal at least a portion of the right and left sides of lift mechanism 12. Further, as best seen in FIG. 8, the bottom portion of lift mechanism 12 is partially concealed by tightening pull cord 68 and fastening it in place with locking clasp 70. The rods 60 are used to prevent any sagging of right and left side panels 48, 50. As best seen in FIG. 2, apertures 64 operate to couple skirt 10 to support frame 18 and maintain skirt 10 in place on frame 18 as the skirt 10 is stretched between support frame 18 and base 22. Lift chair may then be moved back to a seated position as shown in FIG. 4. Finally, as the chair is moved to the tilted position, front and rear bars 72, 74 provide a smooth surface over which the material of skirt 10 passes, reducing the wear that may be experienced by the material.

As best seen in FIG. 5, footrest 26 may be moved to an extended position. Without skirt 10 in place, the lift mechanism 12 would be partially exposed to the external environment in this position between a bottom edge 80 of footrest 26 and support frame 18. With skirt 10 in place, when footrest 26 is in an extended position, front panel 44 of skirt 10 operates to form a barrier between lift mechanism 12 and the external environment. Thus, skirt 10 operates to conceal lift mechanism 12 when lift chair 14 moves between seated, tilted and reclined positions.

It can, therefore, be seen that the invention is one that is designed to overcome the drawbacks and deficiencies existing in the prior art. The invention provides a skirt that surrounds the lift mechanism of a lift chair and that does not interfere with the operation of the lift mechanism.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

Having thus described the invention, what is claimed is:

1. An apparatus for concealing a lift mechanism associated with a lift chair, the chair having a seating unit and support frame, said apparatus comprising:

a front panel having a first edge including a first coupling mechanism;

a rear panel having a second edge including a second coupling mechanism, wherein the first coupling mechanism is releasably connectable with the second coupling mechanism on a top of the support frame; and a pair of side panels coupling said front panel with said rear panel, wherein a bottom edge of each of said panels includes a mechanism for tightening the apparatus underneath the support frame;

wherein said front panel, side panel and rear panels are made of an elastic material and are sized to be coupled between the support frame and the seating unit to conceal at least a portion of the lift mechanism when installed on the chair.

2. The apparatus as recited in claim 1, wherein the first coupling mechanism and the second coupling mechanism comprise a zipper coupled to said front panel and rear panel, wherein said front and rear panels are shaped to extend over the top of said lift mechanism whereby said zipper selectively couples said front panel with said rear panel.

3. The apparatus as recited in claim 1, further comprising:

a first skirt bar adapted to be coupled with the seating unit adjacent a rear portion thereof; and a zipper coupled to said front and rear panels, wherein said rear panel is shaped to extend around said first skirt bar whereby said zipper selectively couples said front panel with said rear panel.

4. The apparatus as recited in claim 3, further comprising:

a second skirt bar adapted to be coupled with the seating unit adjacent a front portion thereof, wherein said front panel is shaped to extend around said second skirt bar.

5. The apparatus as recited in claim 1, wherein said side panels have an edge adjacent said rear panel and an opposite edge adjacent said front panel, and wherein said side panels have a top edge extending between said edge adjacent said rear panel to said edge adjacent said front panel that tapers from the rear panel to the front panel.

6. The apparatus as recited in claim 1, wherein the mechanism for tightening comprises a pull cord coupled to a bottom portion of said front panel, rear panel and side panels, wherein said pull cord selectively secures said front panel, rear panel and side panels to the support frame.

7. An apparatus for concealing a lift mechanism associated with a lift chair, the chair having a seating unit and support frame, said apparatus comprising:

a front panel;

a rear panel; and a pair of side panels coupling said front panel with said rear panel;

wherein said front panel, side panel and rear panels are made of an elastic material and are sized to be coupled between the support frame and the seating unit to conceal at least a portion of the lift mechanism when installed on the chair, and wherein said front panel has at least one aperture formed therein, wherein said aperture allows said front panel to be coupled with the support frame.

8. A skirt for shrouding a lift mechanism associated with a lift chair, said lift chair including a seating unit and a support frame, said skirt comprising:

a first skirt bar adapted to be coupled with the seating unit adjacent a rear portion thereof;

a second skirt bar adapted to be coupled with the seating unit adjacent a front portion thereof;

a front panel sized to extend around said second skirt bar and over a top portion of the lift mechanism;

a rear panel sized to extend around said first skirt bar and over the top portion of the lift mechanism;

a pair of side panels coupling said front panel with said rear panel;

a coupling mechanism selectively coupling said front panel and rear panel over the top portion of the lift mechanism; and a pull cord coupled to a bottom portion of said front panel, rear panel and side panels, wherein said pull cord selectively secures said skirt to the support frame when the skirt is installed on the chair, wherein said skirt creates a barrier between the lift mechanism and an external environment.

9. The skirt as recited in claim 8, wherein said front panel has at least one aperture formed therein to allow a portion of the support frame to extend therethrough.

10. The skirt as recited in claim 8, wherein said rear panel has at least one aperture formed therein to allow a portion of the support frame to extend therethrough.

11. A method for shrouding a lift mechanism associated with a lift chair, wherein the lift chair is capable of moving between a seated position and a tilted position, and wherein the lift chair includes a support frame and seating unit, said method comprising:

providing a piece of elastic material constructed to surround at least a portion of the lift mechanism, wherein the piece of elastic material includes four panels;

coupling said piece of material to a top of the support frame by releasably coupling upper edges of two opposing panels and securing the piece of material to a bottom of the support frame by securing the piece of material underneath the support frame; and coupling said piece of material to the seating unit, wherein said piece of material conceals at least a portion of the lift mechanism when the lift chair is in the tilted or reclined position.

12. The method of claim 11, further comprising:

providing a pull cord along a lower edge of said piece of material; and tightening said pull cord to secure said piece of material underneath said support frame.

13. A method for shrouding a lift mechanism associated with a lift chair, wherein the lift chair is capable of moving between a seated position and a tilted position, and wherein the lift chair includes a support frame and seating unit, said method comprising:

providing a piece of elastic material constructed to surround at least a portion of the lift mechanism;

coupling said piece of material to the support frame; and coupling said piece of material to the seating unit, wherein said piece of material conceals at least a portion of the lift mechanism when the lift chair is in the tilted or reclined position;

forming at least one aperture in said piece of material; and placing a portion of said support frame through said aperture to couple said piece of material to said support frame.

14. A lift chair comprising:

a support frame;

a seating unit;

a lift mechanism coupling said support frame with said seating unit, wherein said lift mechanism selectively moves said seating unit from a seated position to a tilted position by separating said seating unit from said support frame; and a fabric skirt coupled between said support frame and said seating unit to form a barrier between said lift mechanism and an external environment, the fabric skirt including four panels, wherein two opposing panels include a releasable attachment mechanism for attaching a first panel edge to a second panel edge over a top of said lift mechanism, and wherein all of said four panels surround the lift mechanism.

15. The lift chair as recited in claim 14, wherein the skirt includes:

a front panel;

a rear panel; and a pair of side panels coupling said front panel with said rear panel, wherein a front panel edge and a rear panel edge include the releasable attachment mechanism for attaching the front panel edge and the rear panel edge over the top of said lift mechanism, and wherein said front panel, said rear panel and said side panels surround the lift mechanism.

16. The lift chair as recited in claim 15, wherein the releasable attachment mechanism comprises:

a zipper.

17. The lift chair as recited in claim 15, further comprising:

a first skirt bar adapted to be coupled with said seating unit; and a zipper connected between said front and rear panels, wherein said rear panel is constructed to extend around said first skirt bar, and wherein said zipper selectively couples said front panel with said rear panel.

18. The lift chair as recited in claim 17, further comprising:

a second skirt bar coupled with a base, wherein said front panel is sized to extend around said second skirt bar.

19. The lift chair as recited in claim 14, further comprising:

a pull cord coupled with said skirt, wherein said pull cord selectively secures said skirt to said support frame.

20. A lift chair comprising:

a support frame;

a seating unit;

a lift mechanism coupling said support frame with said seating unit, wherein said lift mechanism selectively moves said seating unit from a seated position to a tilted position by separating said seating unit from said support frame; and a fabric skirt coupled between said support frame and said seating unit to form a barrier between said lift mechanism and an external environment, wherein said skirt has at least one aperture formed therein to allow a portion of the support frame to extend therethrough.

* * * * *